United States Patent [19]

Finamore

[11] Patent Number: 4,731,502

[45] Date of Patent: Mar. 15, 1988

[54] LIMITED BEND-RADIUS TRANSMISSION CABLE ALSO HAVING CONTROLLED TWIST MOVEMENT

[75] Inventor: Domenico Finamore, Wilmington, Del.

[73] Assignee: W. L. Gore & Associates, Inc., Newark, Del.

[21] Appl. No.: 921,690

[22] Filed: Oct. 21, 1986

[51] Int. Cl.[4] ..... H01B 7/18

[52] U.S. Cl. ..... 174/74 R; 174/106 R; 174/107; 174/109

[58] Field of Search ..... 174/355 M, 74 R, 106 R, 174/106 D, 107, 109; 333/243, 260; 138/135; 339/28, 29 R

[56] References Cited

U.S. PATENT DOCUMENTS

| | | | |
|---|---|---|---|
| 1,095,648 | 5/1914 | Lutz | 138/135 |
| 2,028,793 | 1/1936 | Mascuch | 174/109 |
| 2,189,091 | 2/1940 | Unterbusch | 174/106 R |
| 2,367,944 | 1/1945 | Ingalls | 138/51 |
| 2,438,146 | 3/1948 | Candee et al. | 174/68 C |
| 2,520,700 | 8/1950 | Wittlinger | 174/35 SM |
| 2,522,169 | 9/1950 | Frei | 174/109 |
| 2,707,972 | 5/1955 | Cole, et al. | 138/60 |
| 2,781,785 | 2/1957 | Davies | 174/35 SM |
| 3,355,544 | 11/1967 | Costley et al. | 174/106 |
| 3,580,289 | 5/1971 | James, Jr. et al. | 138/121 |
| 3,963,854 | 6/1976 | Fowler | 174/107 X |
| 4,236,509 | 12/1980 | Takahashi et al. | 128/4 |
| 4,376,229 | 3/1983 | Maul et al. | 174/35 R |
| 4,408,089 | 10/1983 | Nixon | 333/243 X |
| 4,425,919 | 1/1984 | Alston, Jr. et al. | 128/658 |
| 4,427,033 | 1/1984 | Ege | 138/103 |
| 4,626,810 | 12/1986 | Nixon | 333/243 |

FOREIGN PATENT DOCUMENTS

| | | | |
|---|---|---|---|
| 3220392 | 12/1983 | Fed. Rep. of Germany | 174/107 |
| 24122 | 3/1911 | United Kingdom | 174/106 R |

*Primary Examiner*—Morris H. Nimmo

*Attorney, Agent, or Firm*—John S. Campbell

[57] ABSTRACT

A limited bend transmission cable for coaxial microwave cables which also has controlled movement under torque. A coaxial microwave transmission line of choice is covered by successive layers of helically-wound armor sheath, hard wire located in the groove of the sheath to aid in control of bend of the cable, a hard wire or braid, insulation, and strain relief boot.

10 Claims, 2 Drawing Figures

LIMITED BEND-RADIUS TRANSMISSION CABLE ALSO HAVING CONTROLLED TWIST MOVEMENT

BACKGROUND OF THE INVENTION

Many current radio frequency applications are critical with regard to the stability of the signal path attenuation, the signal path phase length, and the signal path return loss. A component which is frequently found in the signal path, and one which is well known to be a major contributor to signal path instabilities, is the flexible transverse electromagnetic mode (TEM) transmission line, which is often subject to flexure during use. This flexure most often also applies torque forces to the transmission line, in that one end of the line is displaced rotationally from the opposite end of the line, which causes twisting of the transmission line. Further, since such transmission lines are often handled during use, they are sometimes subject to accidental crushing.

TEM transmission lines are of coaxial geometry. They consist of a center conductor concentrically surrounded by a dielectric medium, one or more tubular outer conductors, and an insulating outer jacket. The line is terminated by two coaxial connectors which allow the line to be connected to equipment with mating counterpart connectors.

The combination of the coaxial geometry of the line and its physical restraint at both ends via the attached coaxial connectors dictates that when the line is bent, as during flexure, physical path lengths within the line must change. In particular, the path length of the tubular outer conductor must increase on the outside of the bend, and must decrease on the inside of the bend. This is due to a difference in bend radii for each path, said difference being equal to the cable diameter, and the connector restraint, which results in an extension force applied to the tubular outer conductor at the outside of the bend, and a compression force applied at the inside of the bend. To a lesser extent, the dielectric medium and the center conductor are similarly distorted. These path-length changes are magnified with decreasing bend radii, and, at some point, failure of the tubular outer conductor will occur due to the stresses involved, quite often damaging the dielectric medium as well.

Torque forces which are applied to the line twist the outer conductor, in effect altering its physical path length. If the twisting is severe enough, the diametrical relationship of the outer conductor to the center conductor is altered and/or the concentric relationship of the center conductor, dielectric medium, and tubular outer conductor is disturbed. If crushing forces are applied to the line, non-concentricity will result.

In general, even minor physical path-length changes, alterations of concentricity, changes in diametrical relationship, or distortions of any single element of the TEM transmission line will cause the electrical characteristics of phase length, attenuation, and return loss to change. This is of little or no consequence in most microwave applications where the TEM transmission line is bent for routing but is not flexed during use. In these cases, the change of electrical characteristics is usually slight. Further, systems which are critical to such slight changes are usually designed so that the results of such changes are negated via adjustment, and since the line remains fixed in position, the net change is zero.

A TEM transmission line which is subjected to flexure during use, however, presents a quite different problem. Since it is subjected to bending and torque in a nearly infinite number of radii, bend planes, compound bend planes, etc., changes of electrical performance are of a dynamic nature and not predictable in extent. In test equipment applications, in particular, this may present a severe problem. This equipment is set to a zero reference with the TEM transmission lines in a fixed position. When the cables are flexed during the movement necessary to connect them to the item under test, dynamic changes in electrical performance occur, to some degree shifting the reference from zero and introducing non-predictable errors in the measurements performed. This condition is commonly referred to as transmission line instability error.

It is well known in the art that the degress of instability increases with decreasing bend radius and with increasing torque forces. It is also known that the useful life of the transmission line decreases as the bend radius is decreased and the amount of twist (torque) is increased. There is, in fact, a bend radius and/or an angular displacement due to twisting that will permanently degrade or possibly destroy the electrical performance characteristics of any microwave coaxial transmission line. Crushing is, of course, catastrophic in nature.

Due to these considerations, it has been usual in applications which require flexure to attempt to limit the amount of transmission line instability, and extend the useable life, by specifying the allowable bend radius, torque forces, and crushing forces. In practice, however, such specifications are unenforceable. Strict adherence to said specifications becomes the exception rather than the rule, since even if conscious efforts are made to adhere to such specifications, a single mistake (perhaps not even noticed) can physically alter the transmission line to the extent that its stability becomes considerably less than that required, and the useful life of the transmission line is shortened or terminated. This is a result of the inherent physical characteristics of most transmission lines, which allow them to be easily bent to a radius tighter than specified, to be twisted (torqued) an undesirable amount, or to be easily crushed. Even unusual provision for care cannot preclude this occurrence. Attempts to rectify this problem have previously resulted in either very springy, or bendable but not flexible, lines which can still be destroyed with relative ease.

The present invention corrects this situation by employing an external mechanical means for limiting the allowable degree of physical manipulation that the transmission line can experience. This is accomplished by restricting the bend radius to a minimum value, said value being dictated by the attributes of the microwave coaxial transmission line used and the requirements of the application, minimizing the torque forces which are applied to the microwave coaxial transmission line, not allowing it to be excessively twisted, and providing crush resistance to the transmission line. As a result, consistent electrical stability and longer useable life are provided. Further, the present invention retains a high degree of flexibility when bent to any radius larger than the minimum restricted radius.

DESCRIPTION OF THE PREFERRED EMBODIMENTS

The TEM cable for the invention will now be described with reference to the accompanying drawings.

Figure 1:
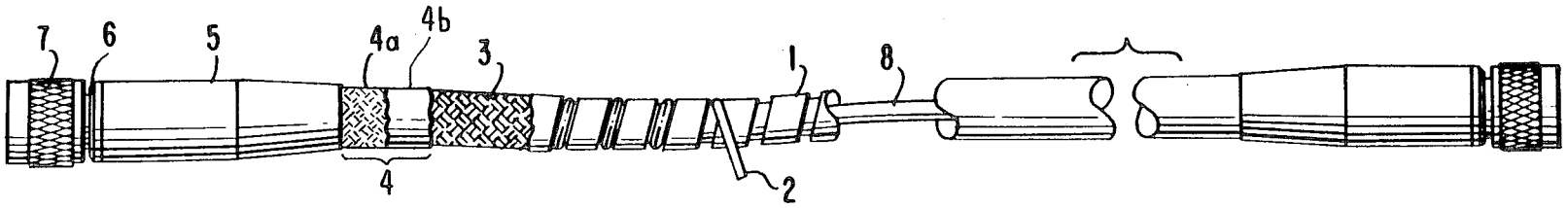
FIG. 1 shows a partially cut-away side view of the TEM cable of the invention.
Figure 2:
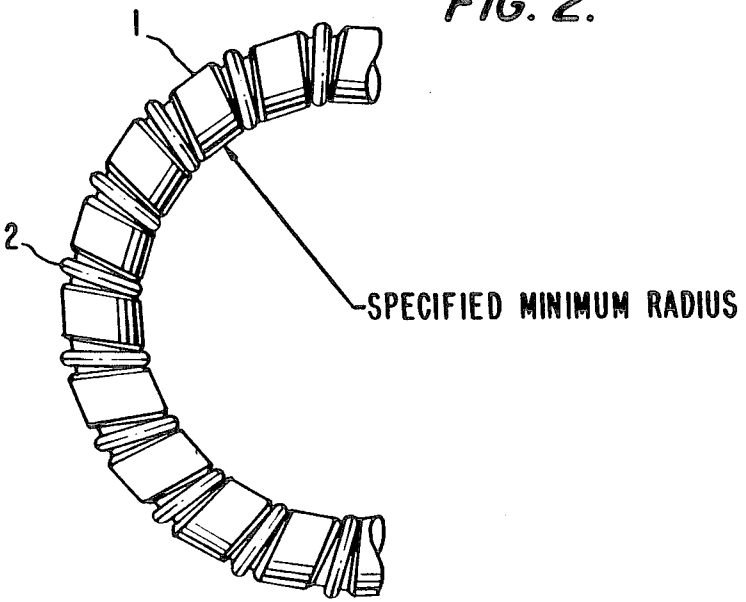
FIG. 2 depicts the bend-radius control layer of the TEM cable of the invention bent to a specified minimum radius.

In FIG. 1, the cut-away view to show the relationship of the various components, 1 is a crush-resistant armor sheath, which is made of a helically wound, formed metallic strip, preferably of stainless steel, with interlocking edges. The sheath dimensions are chosen to obtain the desired inside and outside diameters and self-locking minimum bend radius, which occurs when the interlocking spiral joint walls interfere with each other. The mimimum bend radius of the sheath is chosen to be somewhat smaller than the final desired minimum bend radius, which is ultimately achieved by the combined use of sheath 1 and wire 2.

Wire 2 is a hard metallic wire, usually stainless steel, which is spirally wound into the groove formed by the interlocking joint of sheath 1. The wire 2 may have a round or square cross section. Further, the wire 2 may be spirally wound into either the inner or outer groove. The wire 2 diameter is chosen based on the groove width of sheath 1 and the final desired bend radius. When wire 2 is in place and armor sheath 1 is bent to the desired bend radius, the spiral joint walls of sheath 1, at the inside of the bend, contact wire 2 on both sides, locking the combination at that radius. The combination cannot be bent tighter than desired without the use of excessive force.

A braid 3 of round, flat wire, or of a high tensile strength fiber material covers the sheath 1 and wire 2. In addition to a single braid, a plurality of braids of round wire, flat wire, high tensile strength fiber or a combination thereof may be used. This braid 3 provides the basic twist-limiting characteristics of the invention, which characteristics are determined by the attributes of the transmission line and the needs of the application, and can be altered as required by material selection (e.g., type and size of wire or fiber), by braid design (e.g., number of carriers and ends), coverage and braiding angle, and to some extent, the design, material, and manufacturing method of the insulating jacket 4. The braid material may be stainless steel, steel, beryllium/-copper, copper-clad steel or the like, or may be a polyaramide, polyester, fiberglass, or other high tensile strength fiber.

Insulating jacket 4 affects the twist-limiting characteristics and the relative flexibility of the inventive cable. Jacketing materials, normally thermoplastic or elastomeric, can be chosen for their ultimate effect on the characteristics as deemed necessary for a specific application. The jacket 4 may be of shrink tubing, extruded, braided, or tape wrapped singly as in 4b or in combination as in 4a plus 4b over braid 3, and may be made of polyvinyl chloride, polyethylene, polyurethane, silicone, fluorocarbons, polymers, polyester, or combinations thereof. Manufacturing methods, such as tightness of the jacket, its thickness, etc. are also design variables.

Strain relief boot 5 provides the means for transferring twist forces from the flexible portion of the cable through the connectors out of the cable. Boot 5 is preferably metallic but may be rigid molded plastic, and is firmly affixed to the flexible portion of the cable as embodied in 1, 2, 3, and 4 via mechanical means, bonding, or any suitable method that precludes slippage in the presence of torque forces.

Connector end 6 provides a means for mounting the connectors of the transmission line, and to transfer twist forces present at boot 5 to those connectors and thence to their mating connectors. The end of the connector is firmly affixed to boot 5 via mechanical means, bonding, or any suitable method that precludes slippage due to torque forces.

The connector body 7 of the transmission line is affixed to the connector ends 6. Any connector type commonly known in the art may be used. It is firmly affixed to connector end 6 via mechanical means, bonding, or any suitable method that prevents rotational movement due to torque forces.

The microwave coaxial transmission line 8 is terminated at both ends to connector 7 in a standard manner. To avoid overstress during flexure or during any induced twisting, the microwave coaxial transmission line 8, is not connected to the apparatus at any other points besides the connectors over the entire length.

Preferred cables of the invention would surround a microwave transmission cable of choice and would have a helically wound sheath 1, wire 2 with a round cross section, wound on the outer groove of the sheath, and braid 3 formed from stainless steel. The jacket 4 over the braid 3 may either be of silicone rubber or formed from a layer of porous expanded polytetrafluoroethylene tape such as that disclosed in U.S. Pat. Nos. 3,953,566; 3,962,153; 4,096,227; and 4,187,390, followed by a jacket of braided polyester. The strain relief boot 5 and the connector end 6 are aluminum and the connector body 7 is usually made of stainless steel or plated brass.

In practice, the application in which the transmission line is to be used is assessed to determine the largest bend radius and the minimum twist which are useable. These criteria result in maximum transmission line stability and flex life. Assuming that the selected transmission line performs satisfactorily when bent to this radius and when twisted to this degree, the apparatus can be designed to provide extreme flexibility at larger radii while preventing bending at tighter radii, and to allow twisting of the apparatus only to the selected degree.

The protection afforded by the invention can allow test specimens to be subjected to hundreds of thousands of 90° bends in all four quadrants, utilizing the self-locking radius of the cable as the limiting device, without significant deterioration of the phase, attenuation, or return loss stability characteristics of the specimens at microwave frequencies. The device has been proven at frequencies as high as 26.5 GHz, and is believed to be useful at even higher frequencies.

It will be apparent to those skilled in the art that various modifications and variations could be made in materials and method for making the cable of the invention without departing from the scope or spirit of the invention.

I claim:

1. A crush resilient flexible transverse electromagnetic mode transmission cable having a controlled bend radius and controlled twist movement under torque, comprising:

(a) a microwave coaxial transmission line;

(b) a flexible crush-resilient helically-wound metallic armor sheath having interlocking edges and grooves between its joints, in which said microwave coaxial transmission line is sheathed;

(c) a metallic wire of a diameter selected to cooperate with the armor in the control on the bend of the cable spirally wound into the groove between the joints of the armor;

(d) a braided high tensile strength wrap surrounding the armor and the wire;

(e) an insulating jacket surrounding said braided wrap;

(f) a strain relief boot surrounding and affixed to the insulating jacket at each end of the cable; and (g) a connector end for fixation of connectors for the microwave transmission line to said strain relief boot and the microwave transmission line at each end of the cable, for joining the transmission cable to a transmission receiving apparatus.

2. A cable of claim 1, wherein the metallic armor (b) and the metallic wire (c) are made of stainless steel.

3. A cable of claim 2, wherein the braided wrap is made from a metal wire.

4. A cable of claim 2, wherein the braided wrap is made from a fiber.

5. A cable of claim 3, wherein the metal wire of the braided wrap is selected from the metals beryllium/copper alloy, steel, stainless steel, or copper-clad steel.

6. A cable of claim 4, wherein the fiber is selected from the group consisting of polyester, fiberglass, or polyaramide.

7. A cable of claim 2, wherein the insulating jacket (e) is extruded from silicone rubber.

8. A cable of claim 2, wherein the insulating jacket (e) is formed of a first layer of porous, expanded polytetrafluoroethylene tape followed by a second layer of polyester braid.

9. A cable of claim 1, wherein said braid wrap is formed of stainless steel, said insulating jacket is silicone rubber, said strain relief boot is aluminum, and said connector end is aluminum, and said connectors are from the group consisting of brass or stainless steel.

10. A cable of claim 2, wherein said braid wrap is formed of stainless steel, said insulating jacket is formed of a first layer of carbon-filled porous, expanded polytetrafluoroethylene tape followed by a second layer of polyester braid, said strain relief boot is aluminum, said connector end is aluminum, and said connectors are from the group consisting of brass or stainless steel.

* * * * *